US008935953B2

(12) United States Patent
Sun et al.

(10) Patent No.: US 8,935,953 B2
(45) Date of Patent: Jan. 20, 2015

(54) ADAPTIVE SOOT MASS ESTIMATION IN A VEHICLE EXHAUST AFTER-TREATMENT DEVICE

(71) Applicant: GM Global Technology Operations LLC, Detroit, MI (US)

(72) Inventors: Min Sun, Troy, MI (US); Michelangelo Ardanese, Royal Oak, MI (US); Amanpal S. Grewal, Novi, MI (US); Paul Jasinkiewicz, Northville, MI (US); Giuseppe Schiavone, Bitonto (IT)

(73) Assignee: GM Global Technology Operations LLC, Detroit, MI (US)

( * ) Notice: Subject to any disclaimer, the term of this patent is extended or adjusted under 35 U.S.C. 154(b) by 62 days.

(21) Appl. No.: 13/894,758

(22) Filed: May 15, 2013

(65) Prior Publication Data

US 2014/0338434 A1 Nov. 20, 2014

(51) Int. Cl.

| | |
|---|---|
| ***G01M 15/10*** | (2006.01) |
| ***F01N 11/00*** | (2006.01) |
| *F01N 9/00* | (2006.01) |

(52) U.S. Cl.

CPC ..... *F01N 11/002* (2013.01); *F01N 9/002* (2013.01)

USPC ..... 73/114.75

(58) Field of Classification Search

CPC ..... F02D 41/029; F02D 2200/0812; F02D 41/0055; F02D 41/027; F01N 9/002; F01N 3/023; F01N 2560/08

USPC ..... 73/114.75

See application file for complete search history.

(56) References Cited

U.S. PATENT DOCUMENTS

| | | | | |
|---|---|---|---|---|
| 6,941,750 | B2 * | 9/2005 | Boretto et al. | 60/297 |
| 7,153,342 | B2 * | 12/2006 | Koga et al. | 95/20 |
| 8,365,586 | B2 * | 2/2013 | Ardanese et al. | 73/114.71 |
| 8,447,461 | B2 * | 5/2013 | Nevin et al. | 701/29.4 |
| 8,468,808 | B2 * | 6/2013 | Ardanese et al. | 60/295 |
| 8,478,565 | B2 * | 7/2013 | Ardanese et al. | 702/173 |
| 8,577,541 | B2 * | 11/2013 | Nevin et al. | 701/29.4 |
| 8,660,741 | B2 * | 2/2014 | Nevin et al. | 701/34.4 |
| 2007/0251214 | A1 * | 11/2007 | Nishino et al. | 60/277 |
| 2013/0291520 | A1 * | 11/2013 | Schiavone et al. | 60/274 |

* cited by examiner

*Primary Examiner* — Freddie Kirkland, III

(74) *Attorney, Agent, or Firm* — Quinn Law Group, PLLC

(57) ABSTRACT

A method of estimating a total amount of soot in a diesel particulate filter includes monitoring a pressure differential across the diesel particulate filter; monitoring an engine speed and an engine load from an engine in fluid communication with the diesel particulate filter; determining a first soot mass estimate from the monitored pressure differential, the first soot mass estimate having an associated confidence indicator based on the monitored engine speed and engine load; determining a second soot mass estimate from the monitored engine speed and engine load; and outputting the first soot mass estimate if the confidence indicator is above a predetermined threshold, and outputting the second soot mass estimate if the confidence indicator is below the predetermined threshold.

17 Claims, 2 Drawing Sheets

ADAPTIVE SOOT MASS ESTIMATION IN A VEHICLE EXHAUST AFTER-TREATMENT DEVICE

TECHNICAL FIELD

The present invention relates to a method of monitoring a particulate filter in an exhaust gas after-treatment system using a differential pressure module.

BACKGROUND

Various exhaust after-treatment devices, such as particulate filters and other devices, have been developed to effectively limit exhaust emissions from internal combustion engines. In the case of compression-ignition or diesel engines, a great deal of effort continues to be expended to develop practical and efficient devices and methods to reduce emissions of largely carbonaceous particulates otherwise present in the engine's exhaust gas.

An after-treatment system for a modern diesel engine exhaust typically incorporates a diesel particulate filter (DPF) for collecting and disposing of the sooty particulate matter emitted by the diesel engine prior to the exhaust gas being discharged to the atmosphere. A typical DPF acts as a trap for removing the particulate matter from the exhaust stream. The DPF may also contain precious metals, such as platinum and/or palladium, which serve as catalysts to passively oxidize soot and hydrocarbons present in the exhaust stream. In many instances, the DPF may be regenerated or cleaned using superheated exhaust gas to burn off the collected particulate.

The particulate matter included in the engine exhaust gasses may include carbonaceous soot particulates that may be oxidized to produce gaseous carbon dioxide, as well as other non-combustible particulates (i.e., ash) that are not capable of being oxidized. The composition and morphology of exhaust gasses is largely a function of the fuel, engine type, engine design, engine operation and control methodology, environmental operating conditions and other factors. For example, engine lubricating oil that passes into the combustion chamber and is partially burned produces the majority of ash. As a further example, combustion in gasoline engines may produce submicron organic matter (OM), as well as sulfates and elemental silicon, iron, or zinc or sulfur. The elemental silicon, iron and zinc are non-combustible particulates and may comprise ash. As another example, combustion in diesel engines may also produce OM, sulfates and elemental silicon, iron, zinc or sulfur, as well as soot and ammonium.

While the pressure drop across the particulate filter may ordinarily be a good proxy for trapped soot mass concentration, in certain temperature ranges and at certain nitrogen dioxide levels in the exhaust flow, the pressure drop may become a less accurate predictor. These inaccuracies may be due to, for example, passive and nonhomogeneous burning of soot in the filter that may change the soot distribution in the filter (i.e., reducing the correlation between pressure drop over the filter and soot mass in the filter). For example, nonhomogeneous burning may cause cracks in the soot layer, reducing the resistance to flow. Such soot estimation inaccuracies may either result in a decrease in the filtering efficiency of the particulate filter, or may cause the filter to be actively regenerated at lower soot concentrations, which may decrease fuel efficiency.

SUMMARY

A system for monitoring a particulate filter of an exhaust after-treatment device in fluid communication with an engine of a vehicle includes a first fluid tube, a second fluid tube, a differential pressure module in communication with the first fluid tube and the second fluid, and a controller.

The first fluid tube is disposed in fluid communication with the exhaust after-treatment device between the particulate filter and the engine. The second fluid tube is disposed in fluid communication with the exhaust after-treatment device, on an opposite side of the particulate filter from the first fluid tube. Finally, the differential pressure module is in communication with each of the first fluid tube and the second fluid tube, and is configured to generate a delta-pressure signal corresponding to a pressure drop between the first fluid tube and the second fluid tube.

The controller is in communication with the differential pressure module and is configured to: receive the delta-pressure signal; monitor an engine speed and an engine load from the engine; and determine a first soot mass estimate from the received delta-pressure signal, wherein the first soot mass estimate has an associated confidence indicator based on the monitored engine speed and engine load. The controller is further configured to: determine a second soot mass estimate from the monitored engine speed and engine load; output the first soot mass estimate if the confidence indicator is above a predetermined threshold, and output the second soot mass estimate if the confidence indicator is below the predetermined threshold. Finally, the controller may be configured to generate a particulate filter regeneration request if the soot mass estimate exceeds a threshold.

In one configuration, the controller may be configured to determine the first soot mass estimate from the received delta-pressure signal by selecting a value from a delta-pressure lookup table according to the received delta-pressure signal. Additionally, the controller may be configured to determine the second soot mass estimate from the monitored engine speed and engine load by: selecting an instantaneous engine soot mass output value from an engine-out lookup table according to the monitored engine speed and engine load; and integrating the instantaneous engine soot mass output value.

In an extension of the present system, the controller may be configured to modify the engine-out lookup table using a difference between the first soot mass estimate and second soot mass estimate. In this manner, the system may self correct as the engine deviates from the model over its usable life. For example, the engine-out lookup table may include a plurality of points representing engine soot production at different engine speed/engine load combinations, and wherein the controller is configured to modify the engine-out lookup table by: monitoring a time that the engine operates at each respective engine speed/engine load combination; and apportioning a total correction factor to each respective point of the plurality of points according to the amount of time the engine operates at that point.

In this manner, a method of estimating a total amount of soot in a diesel particulate filter includes: monitoring a pressure differential across the diesel particulate filter; monitoring an engine speed and an engine load from an engine in fluid communication with the diesel particulate filter; determining a first soot mass estimate from the monitored pressure differential, wherein the first soot mass estimate has an associated confidence indicator based on the monitored engine speed and engine load. The method further includes: determining a second soot mass estimate from the monitored engine speed and engine load; and outputting the first soot mass estimate if the confidence indicator is above a predetermined threshold, and outputting the second soot mass estimate if the confidence indicator is below the predetermined threshold.

The above features and advantages and other features and advantages of the present invention are readily apparent from the following detailed description of the best modes for carrying out the invention when taken in connection with the accompanying drawings.

DETAILED DESCRIPTION

Figure 1:
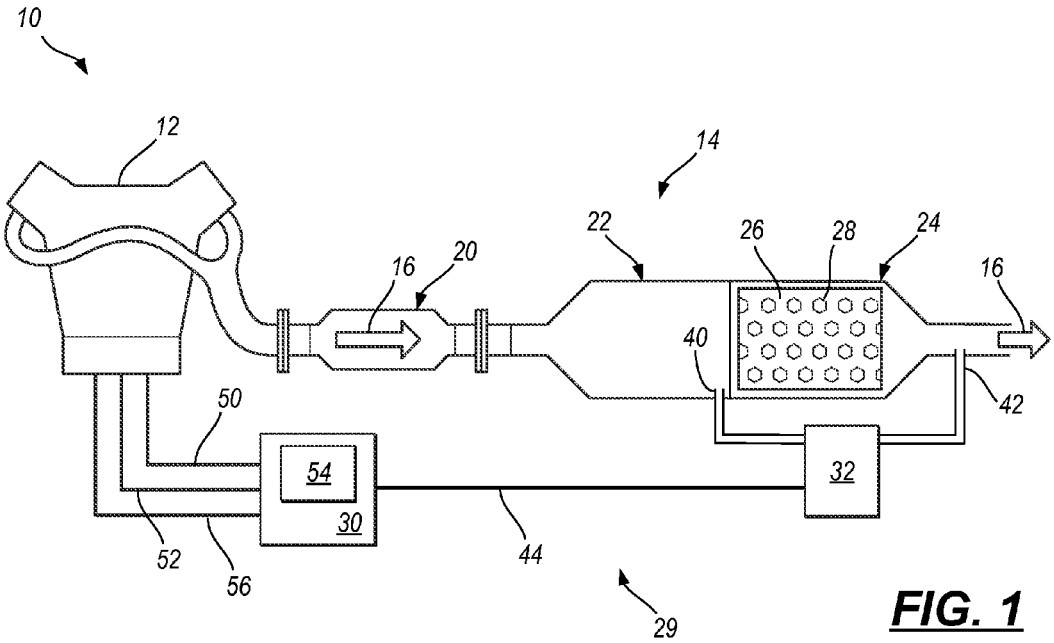
FIG. 1 is a schematic diagram of an engine and an exhaust gas after-treatment system for treating exhaust gas from the engine.

Referring to the drawings, wherein like reference numerals are used to identify like or identical components in the various views, FIG. 1 schematically illustrates a vehicle 10, including an engine 12 and an exhaust gas after-treatment system 14. As may be appreciated, the engine 12 may combust a mixture of fuel and air to provide a motive force for the vehicle 10. The exhaust gas after-treatment system 14 may then direct and treat the byproducts of the combustion (i.e., exhaust gasses) as they flow from the engine 12 (indicated by flow arrows 16). In general, the exhaust gas after-treatment system 14 may remove suspended particulate matter and NOx gasses from the exhaust flow 16 prior to the gas being expelled from the vehicle 10. In one configuration, the engine 12 may be a compression-ignited diesel engine; however, other types of engine technology may similarly be used.

The exhaust gas after-treatment system 14 may generally include a diesel oxidation catalyst ("DOC") 20, a selective catalytic reduction ("SCR") catalyst 22, and a particulate filter 24. The DOC 20 may passively oxidize and/or burn hydrocarbons in the exhaust flow 16, as they exit the engine 12. The SCR catalyst 22 may include a chemical agent that is selectively introduced into the exhaust flow 16 to convert at least some of the nitrogen oxides in the exhaust flow 16 into water and nitrogen.

Finally, the particulate filter 24 may be configured to filter particulate matter, i.e., soot, from the exhaust gas of the engine 12. The particulate filter 24 may include one or more substrates 26 that define a plurality of apertures 28 through which the exhaust gas must flow. As the exhaust gas passes through the particulate filter 24, suspended airborne particulate matter may collect on the substrate 26, where it may be separated from the flow 16.

Over the life of the vehicle 10, the particulate filter 24 may occasionally need to be regenerated to remove any collected particulate matter. In one configuration, the particulate filter 24 may be regenerated by heating the particulate filter 24 to a temperature sufficient to burn the particulate matter off of the substrate 26. In one configuration, the high temperature may be provided by adjusting the air/fuel ratio provided to the engine 12 to be slightly richened, which may then be maintained for a period of time sufficient to burn off a majority of the particulate matter from the substrate 26. In general, the process of "burning off" the particulate matter may involve converting the sooty trapped particulate matter into carbon dioxide, which may be more permissibly dissipated into the atmosphere.

A monitoring system 29 may be employed to monitor various real-time operating parameters of the exhaust flow 16 and estimate the amount of soot contained within the particulate filter 24. If the estimate exceeds a predetermined threshold, the monitoring system may request a regeneration from the engine (or an associated engine controller) to burn off the collected soot within the filter 24. The monitoring system 29 may include a controller 30 configured to determine a flow impedance of the particulate filter 24 by monitoring a differential pressure sensor module 32 disposed across the particulate filter 24.

The differential pressure sensor module 32 may monitor a pressure drop across the substrate 26 using a first fluid tube 40 in fluid communication with the after-treatment system 14 at a location upstream of the filter 24 (i.e., between the filter 24 and the engine 12) and a second fluid tube 42 in fluid communication with the after-treatment system 14 at a location downstream of the filter 24 (i.e., on an opposite side of the particulate filter 24 from the first fluid tube 40). The differential pressure module 32 may detect a pressure drop between the respective first and second fluid tubes 40, 42, and may provide a signal 44 (i.e., the delta-pressure signal 44) to the controller 30 that is indicative of the magnitude of the difference. In another configuration, one or more electronic pressure sensors may be used to determine the pressure drop across the particulate filter 24. An electronic pressure sensor may include a piezoresistive sensor, a piezoelectric sensor, a MEMS sensor, and/or a capacitive sensor configured to convert a sensed pressure into an analog or digital signal representative of the sensed pressure.

In addition to receiving the delta-pressure signal 44, the controller 30 may receive an indication of a current engine speed 50 and a current engine load 52 from the engine 12 or an associated engine controller. In general, the controller 30 may use the sensed pressure drop 44, engine speed 50, and engine load 52 as inputs into a soot model 54 that may estimate the status/capacity of the particulate filter 24. As will be described in greater detail below, during certain operating conditions, the soot model 54 may use the sensed pressure drop across the particulate filter to estimate the number of grams of soot collected within the particulate filter 24.

When the soot model 54 estimates that the particulate filter 24 requires regeneration (i.e., the amount of estimated soot exceeds a soot threshold), the controller 30 may provide a control signal 56 to the engine 12 or to an associated engine controller to adjust the operation of the engine 12 and initiate the regeneration. As mentioned above, in one configuration, the controller 30 may initiate a filter regeneration event by increasing the amount of fuel provided to the engine until the fuel/air ratio is slightly rich of a stoichiometric balance.

The controller 30 may include a computer and/or processor, and include all software, hardware, memory, algorithms, connections, sensors, etc., necessary to monitor and control the exhaust gas after-treatment system 14, engine 12, and/or the differential pressure module 32. As such, a control method operative to evaluate the soot model 54 and/or to initiate a regeneration may be embodied as software or firmware associated with the controller 30. It should be appreciated that the controller 30 may also include any device capable of analyzing data from various sensors, comparing data, making the necessary decisions required to control the exhaust gas after-treatment system 14, as well as monitoring the differential pressure module 32.

Figure 2:
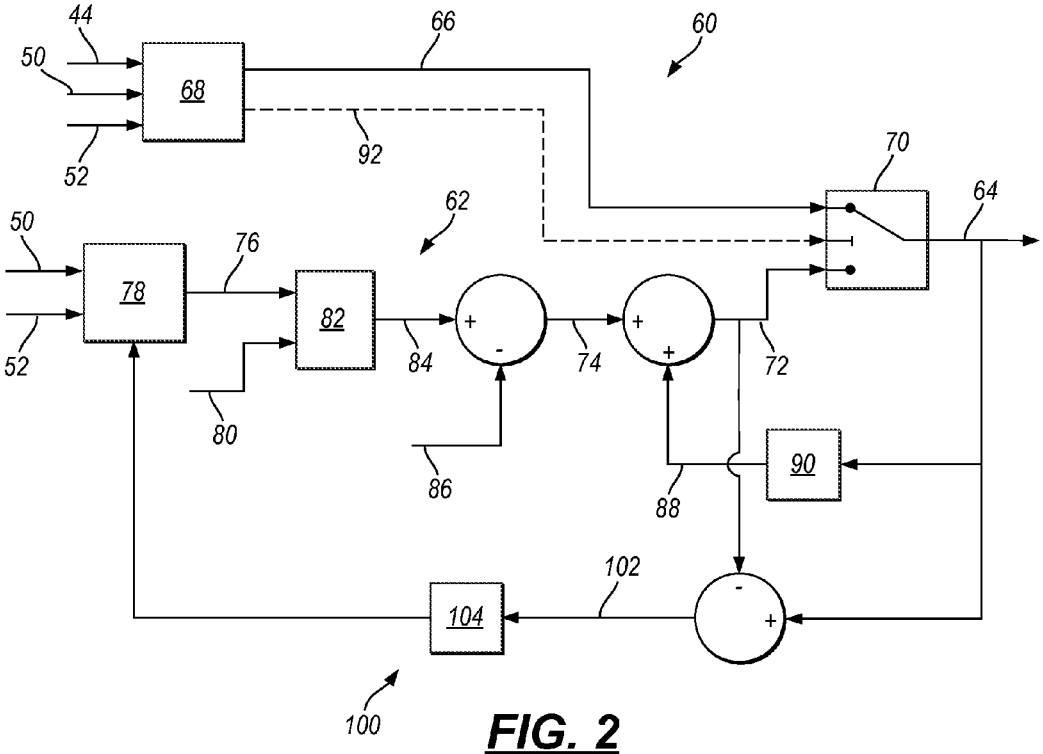
FIG. 2 is a schematic diagram of a soot model including a delta-pressure soot model and an engine-out soot model.

FIG. 2 schematically illustrates a functional block diagram of an embodiment of an adaptive soot model 54. In general, the soot model 54 may intelligently switch between two different soot estimation schemes 60, 62 to estimate a total amount of soot 64 accumulated within the particulate filter 24. The first estimation scheme 60 may be primarily based on the sensed pressure drop 44 across the particulate filter 24

(i.e., a Delta-Pressure Soot Model 60), while the second estimation scheme 62 may be primarily based on engine operating parameters, such as engine speed 50 and engine load 52 (i.e., an Engine-Out Soot Model 62).

The Delta-Pressure Soot Model 60 may operate by outputting a Delta-Pressure soot mass estimate 66 for a given sensed pressure drop 44 at a particular engine speed 50 and engine load 52. The Delta-Pressure Soot Model 60 may be based on an empirical delta-pressure soot-map 68 that stores a plurality of soot mass estimates 66, each as a function of a known pressure drop 44, engine speed 50, and engine load 52. Additionally, other inputs that may be utilized by the delta-pressure soot-map 68 may include, for example, exhaust mass flow rate and DPF temperature. The delta-pressure soot-map 68 may be embodied, for example, as a lookup-table, which may be populated through empirical testing of the particular engine 12 and after-treatment system 14 configuration.

A Delta-Pressure Soot Model 60 may provide an accurate assessment of the total amount of soot 64 within a particulate filter 24, though only during very limited engine operating conditions. In particular, this estimation methodology may be most reliable during steady-state (i.e., non-transient) operation, at a steady-state operational temperature (i.e., not during a cold start), and at a high exhaust mass-flow rate. These ideal conditions may occur, for example, during steady-state expressway driving. At non-ideal conditions, for example, the signal-to-noise ratio may be below a usable minimum due to sensor variability and/or noticeable harmonics of the exhaust flow.

To provide continuous updating to the estimated total amount of soot 64 accumulated within the particulate filter 24, the soot model 54 may include a switch 70 that is used to alternate between the empirical Delta-Pressure Soot Model 60 (during periods of high-confidence/reliability for the Delta-Pressure soot mass estimate 66), and an analytical, Engine-Out Soot Model 62 (during periods of lower-confidence/reliability for the Delta-Pressure soot mass estimate 66).

The analytical, Engine-Out Soot Model 62 may output an Engine-Out soot mass estimate 72 based on an integral of the net amount of instantaneous soot accumulation 74 at the particulate filter 24. The Engine-Out Soot Model 62 may begin by estimating an instantaneous amount of soot output 76 from the engine 12, given the current engine speed 50 and engine load 52.

The instantaneous amount of soot output 76 may be computed from an analytical combustion formula, or, for ease/speed of computation, may be retrieved from an engine-out soot map 78. The instantaneous amount of soot output 76 may represent the amount of soot generated by the engine 12 for the current amount of air-intake, current amount of provided fuel, at the current speed 50 and load 52. In some embodiments, the engine-out soot map 78 may further consider the engine operating temperature, the air-intake temperature, and/or the combustion temperature in determining the instantaneous amount of soot output 76. Other inputs that may be considered include, for example, a ratio of air/fuel supplied to the engine 12 an exhaust gas recirculation rate, fuel injection timing, and/or intake/exhaust manifold pressure. The engine-out soot map 78 may represent the soot output according to an idealized model of the engine, or as a product of actual engine testing. In either instance, the map 78 may begin by assuming that the present engine 12 is operating in a similar manner as the idealized model/test engine.

Following the estimation of instantaneous soot output 76, the model 62 may multiply the output 76 by an estimated filter efficiency 80 (at 82) to arrive at an estimated amount of soot 84 that will be trapped by the filter 24. The estimated filter efficiency 80 may be a fractional number that, for example, represents the amount of soot trapped by the filter 24 divided by the total amount of soot in the exhaust flow 16. In one configuration, the filter efficiency 80 may be a function of the exhaust flow-rate, temperature, soot concentration in the flow, and/or total amount of soot 64 within the particulate filter 24. In another configuration, the filter efficiency 80 may be a constant that may solely depend on the material and configuration of the filter 24.

The estimated amount of soot 84 that will be trapped by the filter 24 may then be offset by an estimated amount of soot 86 that will be burned off through normal engine operation. This offset 86 may be a function of exhaust flow-rate, exhaust temperature, and/or total amount of soot 64 within the particulate filter 24. Following the offset, the model may arrive at the net amount of instantaneous soot accumulation 74, which may be added to a previous total amount of soot 88 accumulated within the particulate filter 24 (time shifted at 90) to arrive at a new (current) total amount of soot 64.

While the Engine-Out Soot Model 62 may be relatively accurate over short periods of time, small errors in the assumptions may compound over time to result in a substantial drift over longer periods. Therefore, the switch 70 may alternate the estimation method between the empirical Delta-Pressure Soot Model 60 (during periods of high-confidence/reliability for the Delta-Pressure soot mass estimate 66), and the analytical, Engine-Out Soot Model 62 (during periods of lower-confidence/reliability for the Delta-Pressure soot mass estimate 66). In one configuration, the delta-pressure soot-map 68 may output a confidence indicator 92 that may serve as the toggle to transition between the two models 60, 62. During periods of high confidence/reliability, such as during steady-state operating conditions with sufficient exhaust flow, the confidence indicator 92 may cause the switch 70 to use the output of the Delta-Pressure Soot Model 60. During transient operating conditions, periods of low exhaust flow, or during cold starts, the confidence indicator 92 may be low and cause the switch 70 to use the output of the Engine-Out Soot Model 62.

Switching between the two models 60, 62 in the manner described above allows the controller 30 to make an attempt at keeping a continuously up-to-date soot mass estimate 66. In other prior embodiments, the Delta-Pressure Soot Model 60 merely waited for a recurrence of the ideal testing conditions before updating the soot mass estimate 66. For highly transient drivers (e.g., an airport shuttle), the conditions may rarely be satisfied to make an accurate soot mass estimate.

As a further extension of this technology, the soot model 60 may include an engine adaptation routine 100, which may dynamically adjust the engine-out soot map 78 to account for any minor inaccuracies in the Engine-Out Soot Model 62. As illustrated, the engine adaptation routine 100 may calculate the difference 102 between the soot mass estimate 66 and the Engine-Out soot mass estimate 72. At the instant when the switch 70 transitions from the Engine-Out Soot Model 62 to the Delta-Pressure Soot Model 60, the difference 102 in the two signals may represent the drift, or compounded error that has developed in the Engine-Out soot mass estimate 72. This difference may be multiplied by a correction gain 104, and fed back to the engine-out soot map 78 to refine the instantaneous amount of soot output 76 from the engine 12.

Figure 3:
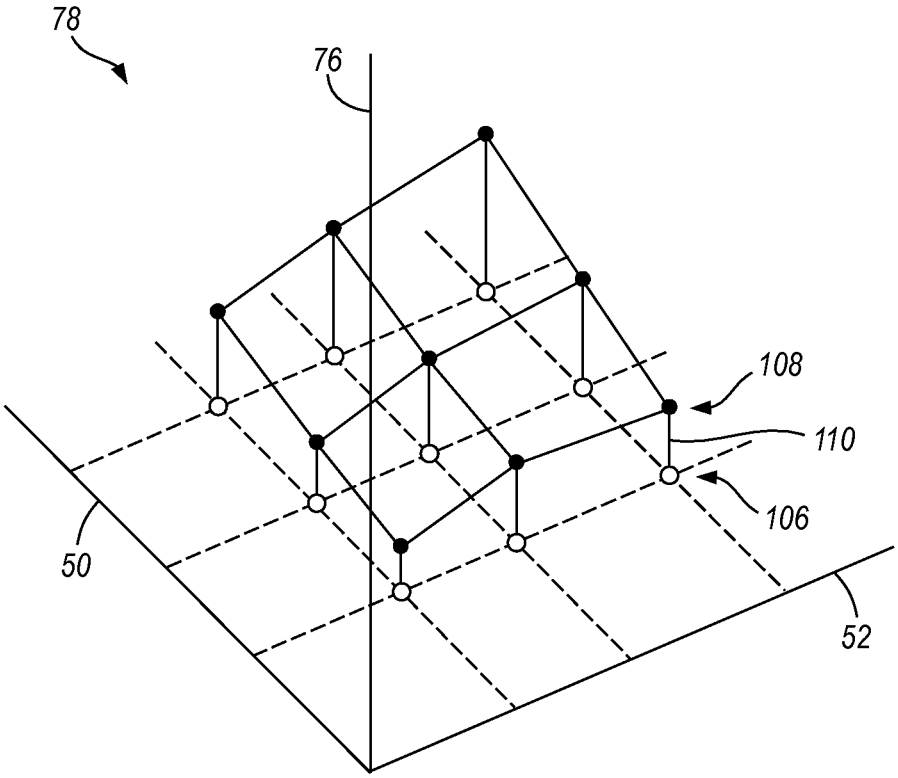
FIG. 3 is a schematic graph of instantaneous engine soot production as a function of engine speed and engine load.

For example, FIG. 3 schematically illustrates an embodiment of an engine-out soot map 78. As shown, engine soot output 76 is illustrated as a function of engine speed 50 and engine load 52 (i.e., where load/torque is proportional to the amount of fuel provided to the cylinders). A first set of points 106, represented by open-circles, illustrate a plurality of initial soot mass estimates for given speed/load combinations. A second set of points 108, represented by filled-circles, illustrate a plurality of refined soot mass estimates for the same respective speed/load combinations. The difference between the second points 108 and first points 106 at each respective combination represents a correction factor (e.g., correction factor 110) that may be applied to the engine-out soot map 78 by the engine adaptation routine 100.

In one configuration, the controller 30 may monitor the total time the soot model 54 remains in the Engine-Out Soot Model 62, and adjust the correction gain 104 as a function of the time. In this manner, the applied correction factor may account for the tendency for errors to exponentially compound over time.

Additionally, as generally illustrated in FIG. 3, in one configuration, different correction factors may be applied to different speed/load combinations. For example, once a total correction factor is determined, it may be apportioned to each of the various points according to experience. Said another way, in addition to monitoring the total time operating in the Engine-Out Soot Model 62, the controller 30 may also monitor the amount of time the Engine-Out Soot Model 62 operates at each speed/load combination. The total correction factor may then be apportioned on a pro-rata basis according to the percentage of time spent at each combination, relative to the total amount of time. In this manner, if the Engine-Out Soot Model 62 operates at a single speed/load combination for the entire duration, it may be assumed that 100% of the error may be attributed to that point; and therefore, 100% of the correction factor may be applied to that point.

While in one configuration, the correction factor may be apportioned strictly on a pro rata basis across the various points based on time, in another configuration, each point may have a slight influence on neighboring points. In this manner, there may be a virtual "spring constant" that ties the points together to preserve a certain degree of continuity within the map (e.g., if the engine operates only at a single speed/load combination for the entire duration, that point may increase by 100% of the correction factor, while surrounding points may increase by a fractional amount of the 100%).

While the best modes for carrying out the invention have been described in detail, those familiar with the art to which this invention relates will recognize various alternative designs and embodiments for practicing the invention within the scope of the appended claims. It is intended that all matter contained in the above description or shown in the accompanying drawings shall be interpreted as illustrative only and not as limiting.

The invention claimed is:

1. A method of estimating a total amount of soot in a diesel particulate filter comprising:

monitoring a pressure differential across the diesel particulate filter;

monitoring an engine speed and an engine load from an engine in fluid communication with the diesel particulate filter;

determining a first soot mass estimate from the monitored pressure differential, the first soot mass estimate having an associated confidence indicator based on the monitored engine speed and engine load;

determining a second soot mass estimate from the monitored engine speed and engine load; and outputting the first soot mass estimate if the confidence indicator is above a predetermined threshold, and outputting the second soot mass estimate if the confidence indicator is below the predetermined threshold.

2. The method of claim 1, further comprising generating a particulate filter regeneration request if the outputted soot mass estimate exceeds a threshold.

3. The method of claim 1, wherein determining a first soot mass estimate from the monitored pressure differential includes selecting a value from a delta-pressure lookup table according to the monitored pressure differential.

4. The method of claim 1, wherein determining a second soot mass estimate from the monitored engine speed and engine load includes:

selecting an instantaneous engine soot mass output value from an engine-out lookup table according to the monitored engine speed and engine load; and integrating the instantaneous engine soot mass output value.

5. The method of claim 4, further comprising modifying the engine-out lookup table using a difference between the first soot mass estimate and second soot mass estimate.

6. The method of claim 5, wherein the engine-out lookup table includes a plurality of points representing engine soot production at different engine speed/engine load combinations;

wherein modifying the engine-out lookup table includes:

monitoring a time that the engine operates at each respective engine speed/engine load combination; and apportioning a total correction factor to each respective point of the plurality of points according to the amount of time the engine operates at that point.

7. A system for monitoring a particulate filter of an exhaust after-treatment device in fluid communication with an engine of a vehicle, the system comprising:

a first fluid tube disposed in fluid communication with the exhaust after-treatment device and between the particulate filter and the engine;

a second fluid tube disposed in fluid communication with the exhaust after-treatment device and on an opposite side of the particulate filter from the first fluid tube;

a differential pressure module in communication with the first fluid tube and the second fluid tube and configured to generate a delta-pressure signal corresponding to a pressure drop between the first fluid tube and the second fluid tube; and a controller in communication with the differential pressure module and configured to:

receive the delta-pressure signal;

monitor an engine speed and an engine load from the engine;

determine a first soot mass estimate from the received delta-pressure signal, the first soot mass estimate having an associated confidence indicator based on the monitored engine speed and engine load;

determine a second soot mass estimate from the monitored engine speed and engine load;

output the first soot mass estimate if the confidence indicator is above a predetermined threshold, and output the second soot mass estimate if the confidence indicator is below the predetermined threshold; and generate a particulate filter regeneration request if the soot mass estimate exceeds a threshold.

8. The system of claim 7, wherein the controller is configured to determine a first soot mass estimate from the received delta-pressure signal by selecting a value from a delta-pressure lookup table according to the received delta-pressure signal.

9. The system of claim 7, wherein the controller is configured to determine a second soot mass estimate from the monitored engine speed and engine load by:

selecting an instantaneous engine soot mass output value from an engine-out lookup table according to the monitored engine speed and engine load; and integrating the instantaneous engine soot mass output value.

10. The system of claim 9, wherein the controller is further configured to modify the engine-out lookup table using a difference between the first soot mass estimate and second soot mass estimate.

11. The system of claim 10, wherein the engine-out lookup table includes a plurality of points representing engine soot production at different engine speed/engine load combinations;

wherein the controller is configured to modify the engine-out lookup table by:

monitoring a time that the engine operates at each respective engine speed/engine load combination; and apportioning a total correction factor to each respective point of the plurality of points according to the amount of time the engine operates at that point.

12. A method of providing a soot mass estimate in a vehicle exhaust after-treatment device comprising:

obtaining a first pressure signal from a first fluid tube disposed in fluid communication with the exhaust after-treatment device and between a particulate filter and an engine;

obtaining a second pressure signal from a second fluid tube disposed in fluid communication with the exhaust after-treatment device and on an opposite side of the particulate filter from the first fluid tube;

determining an exhaust gas pressure drop across the particulate filter from the first pressure signal and the second pressure signal;

determining a first soot mass estimate from the monitored exhaust gas pressure drop;

monitoring an engine speed and an engine load from an engine in fluid communication with the vehicle exhaust after-treatment device;

determining a confidence value for the first soot mass estimate using the monitored engine speed and engine load;

determining a second soot mass estimate from the monitored engine speed and engine load; and providing the first soot mass estimate if the confidence indicator is above a predetermined threshold, and providing the second soot mass estimate if the confidence indicator is below the predetermined threshold.

13. The method of claim 12, further comprising generating a particulate filter regeneration request if the provided soot mass estimate exceeds a threshold.

14. The method of claim 12, wherein determining a first soot mass estimate from the monitored exhaust gas pressure drop includes selecting a value from a delta-pressure lookup table according to the monitored exhaust gas pressure drop.

15. The method of claim 12, wherein determining a second soot mass estimate from the monitored engine speed and engine load includes:

selecting an instantaneous engine soot mass output value from an engine-out lookup table according to the monitored engine speed and engine load; and integrating the instantaneous engine soot mass output value.

16. The method of claim 15, further comprising modifying the engine-out lookup table using a difference between the first soot mass estimate and second soot mass estimate.

17. The method of claim 16, wherein the engine-out lookup table includes a plurality of points representing engine soot production at different engine speed/engine load combinations;

wherein modifying the engine-out lookup table includes:

monitoring a time that the engine operates at each respective engine speed/engine load combination; and apportioning a total correction factor to each respective point of the plurality of points according to the amount of time the engine operates at that point.

* * * * *